US005281307A

United States Patent [19]

Smigo et al.

[11] Patent Number: 5,281,307

[45] Date of Patent: Jan. 25, 1994

[54] CROSSLINKED VINYL ALCOHOL/VINYLAMINE COPOLYMERS FOR DRY END PAPER ADDITION

[75] Inventors: John G. Smigo, Whitehall; Lloyd M. Robeson, Macungie; George Davidowich, Allentown; Gerald D. Miller, Emmaus; William E. Carroll, Orefield, all of Pa.

[73] Assignee: Air Products and Chemicals, Inc., Allentown, Pa.

[21] Appl. No.: 3,760

[22] Filed: Jan. 13, 1993

[51] Int. Cl.[5] ..... D21H 17/33

[52] U.S. Cl. ..... 162/164.3; 162/166; 162/168.2; 162/184; 162/185; 162/186

[58] Field of Search ..... 162/168.1, 168.2, 184, 162/164.3, 185, 186, 158, 165, 166, 167

[56] References Cited

U.S. PATENT DOCUMENTS

| | | | |
|---|---|---|---|
| 3,535,288 | 10/1970 | Lipowski et al. | 260/78 |
| 3,597,313 | 8/1971 | Williams et al. | 162/168.2 |
| 3,597,314 | 8/1971 | Laube et al. | 162/168 |
| 3,715,336 | 2/1973 | Nowak et al. | 260/77.5 BB |
| 4,311,805 | 1/1982 | Moritani et al. | 525/60 |
| 4,421,602 | 12/1983 | Brunnmueller et al. | 162/168.2 |
| 4,614,762 | 9/1986 | Marans et al. | 525/61 |
| 4,772,359 | 9/1988 | Linhart | 162/163 |
| 4,774,285 | 9/1988 | Pfohl et al. | 525/60 |
| 4,808,683 | 2/1989 | Itagaki | 526/307.2 |
| 4,880,497 | 11/1989 | Pfohl et al. | 162/135 |
| 4,978,427 | 12/1990 | Pfohl et al. | 162/168.2 |

FOREIGN PATENT DOCUMENTS

| | | |
|---|---|---|
| 1155597 | 8/1983 | Canada . |
| 0251182 | 12/1988 | European Pat. Off. . |
| 0331048 | 8/1989 | European Pat. Off. . |
| 0337310 | 10/1989 | European Pat. Off. . |

OTHER PUBLICATIONS

J. Martoin, "Practical Aspects of Alkaline Sizing", Nov. 1990 Tappi Journal, p. 139.

Ya Jun Zhori, "Time and Size Wait for No Man," Paper Technology, p. 19, Jul. 1991.

C. A. Finch, "Polyvinyl Alcohol Developments", Ed. C. A. Finch, (1992) pp. 270–273, 591–595; John Wiley & Sons.

G. G. Spence "Encyclopedia of Polymer Science and Engineering", Molecular Weight Determination to Pentadiene Polymers, vol. 10, pp. 761–786, Wiley-Interscience, New York, 1987.

*Primary Examiner*—Peter Chin

*Attorney, Agent, or Firm*—Mark L. Rodgers; William F. Marsh; James C. Simmons

[57] ABSTRACT

An improved papermaking process has been developed to enhance the properties of the resultant paper or paper-type products. The process involves adding a polyvinyl alcohol/vinylamine copolymer along with a crosslinking agent at the dry end step of a conventional papermaking process. Improvements in the properties of the resultant paper products are observed, especially at low levels of copolymer addition.

10 Claims, 3 Drawing Sheets

CROSSLINKED VINYL ALCOHOL/VINYLAMINE COPOLYMERS FOR DRY END PAPER ADDITION

FIELD OF THE INVENTION

This invention relates to a method of improving the properties of cellulosic paper. In another aspect it relates to paper which exhibits improvements in properties such as wet and dry tensile strength, wet and dry burst strength, wet and dry tear resistance, fold resistance, and the like.

BACKGROUND OF THE INVENTION

Cellulosic pulp based products comprise one of the largest and most important markets for commercial materials. The technology involved with paper and cardboard is well developed and comprises many additives to yield a multitude of property improvements. Property improvements desired include wet and dry tensile strength, wet and dry burst strength, wet and dry tear resistance, fold resistance, oil resistance, solvent/stain resistance, etc. Additives to paper are characterized by the position of addition relative to the papermaking process. The addition of additives to the slurried pulp (paper stock) prior to sheet formation is commonly referred to as wet-end addition. The addition to paper after formation and at least partial drying is referred to as dry-end addition.

Various additives are applied to the pulp slurry prior to sheet formation. These include retention aids to retain fines and fillers (e.g. alum, poly(ethyleneimine), cationic starches), drainage aids (e.g. poly(ethyleneimine), defoamers, additives which control pitch or stickies (e.g. microfibers, adsorbent fillers). Additionally wet strength additives such as cationic polyacrylamides and poly(amide amine/epichlorohydrin) are added in the wet end to improve wet strength as well as dry strength. Starch, guar gums, and polyacrylamides are also added to yield dry strength improvements. Urea-formaldehyde and melamine-formaldehyde resins are employed as low cost wet strength additives; however, due to residual formaldehyde these resins have fallen out of favor and are being replaced.

Sizing agents are added to impart hydrophobic character to the hydrophilic cellulosic fibers. These agents are used for liquid containers (e.g. milk, juice), paper cups, and surfaces printed by aqueous inks (to prevent spreading of the ink). Rosin sizes derived from pine trees were initially used as well as wax emulsions. More recently, cellulose-reactive sizes have been employed. These include alkyl ketene dimer (AKD) and alkenyl succinic anhydride (ASA). AKD is discussed b Marton (TAPPI J., p. 139, Nov. 1990) and Zhou (Paper Technology, p. 19, Jul. 1991).

The additives noted above can also be added to the dry-end of the papermaking process. These additives can be added various ways. One of the common methods is referred to as the size press addition. This generally involves nip rolls in which a water solution of the additive(s) is flooded and allowed to penetrate the paper. Other methods of addition include spray application and tub sizing.

Starch is the most commonly employed additive in size press addition. Carboxy methyl cellulose, polyvinyl alcohol, cellulose reactive sizes, wax emulsions are also commonly employed for size press addition. Poly(vinyl acetate) emulsions, as well as poly(ethylene-vinyl chloride), poly(styrenebutadiene) and polyacrylic emulsions are commonly added at the dry-end of the paper making process as a surface size or paper coating additive. The add-on levels (dry additive on dry pulp) at the dry end can be low (0.05–4 wt%) as sizing additives (either surface or internal sizing) or high (4-20+wt% dry-on-dry) in the case of saturation sizing. The properties desired are variable, however, include wet and dry tensile strength, fold resistance, wet and dry burst strength, porosity closing, wet and dry tear strength, printability, surface characteristics, oil resistance, etc.

Specific versions of poly(vinyl alcohol) offer many of these improvements, specifically dry strength, wet strength, fold resistance, burst strength and oil resistance. Poly(vinyl alcohol) is generally added in dry-end application as it has poor substansivity to cellulosic products. Highly crystalline poly(vinyl alcohol) generally yields the best wet strength properties as it is insoluble in cold water. Crosslinking additives such as glyoxal can be added to yield specific property improvements. (See Polyvinyl Alcohol Developments, C.A. Finch, ed. (1992) pp 270–273; 591–595).

The use of functional polymers of various types has been known for many years as a means to improve papermaking processes and paper properties. Several of these resins for improving wet strength of the paper have involved products derived from epihalohydrin. U.S. 3,535,288 Lipowski, et al. (1970) discloses an improved cationic polyamide-epichlorohydrin thermosetting resin as useful in the manufacture of wet-strength paper. U.S. 3,715,336 Nowak, et al. (1973) describes vinyl alcohol/vinylamine copolymers as useful flocculants in clarification of aqueous suspensions and, when combined with epichlorohydrin, as useful wet-strength resins for paper. The copolymers are prepared by hydrolysis of vinylcarbamate/vinyl acetate copolymers made by copolymerization of vinyl acetate and vinyl isocyanate followed by the conversion of the isocyanate functionality to carbamate functionality with an alkanol. Additionally, Canadian Pat. No. 1,155,597 (1983) discloses wet-strength resins used in papermaking, including polymers of diallylamine reacted with epihalohydrin and a vinyl polymer reacted with epihalohydrin wherein the vinyl polymer is formed from a monomer prepared by reacting an aromatic vinyl alkyl halide with an amine, such as dimethylamine.

Functional polymers derived from amides have also been used to improve paper processes. U.S. 3,597,314 Lanbe, et al. (1971) discloses that drainage of cellulose fiber suspensions can be enhanced by the addition of a fully or partially hydrolyzed polymer of N-vinyl-N-methyl carboxylic acid amide. U.S. 4,311,805 Moritani, et al. (1982) discloses paper-strength additives made by copolymerizing a vinyl ester, such as vinyl acetate, and an acrylamide derivative, followed by hydrolysis of the ester groups to hydroxy groups. The presence of the remaining cationic groups enables the polymer to be adsorbed on pulp fibers. Utilities for the polymers as sizing agents, drainage aids, size retention aids and as binders for pigments are disclosed but not demonstrated. U.S. 4,421,602 Brunnmueller, et al. (1983) describes partially hydrolyzed homopolymers of N-vinylformamide as useful as retention agents, drainage aids and flocculants in papermaking. European patent application 0,331,047 (1989) notes the utility of high molecular weight poly(vinylamine) as a wet-end additive in papermaking for improved dry strength and as a filler retention aid. U.S. Pat. No. 4,614,762 discusses a water soluble product of polyethyleneimine reacted with formaldehyde and poly(vinyl alcohol). The product is noted to be useful as an improved drainage and retention aid in papermaking.

More recently, vinylamide copolymers have been disclosed as useful in papermaking to improve the properties of the product. U.S. Pat. No. 4,774,285 Pfohl, et al. (1988) describes amine functional polymers formed by copolymerizing vinyl acetate or vinyl propionate with N-vinylformamide (NVF) followed by 30–100% hydrolysis to eliminate formyl groups and the acetyl or propionyl groups. The copolymer contains 10–95 mole, NVF and 5–90 mole% vinyl acetate or vinyl propionate. The hydrolyzed copolymers are useful in papermaking to increase dry strength and wet strength when added in an amount of 0.1 to 5 wt% based on dry fiber. The polymer can be added to the pulp or applied to the formed sheet. The two polymers used to show dry and wet strength improvements are said to contain 40% and 60% N-vinylformamide before hydrolysis. Lower levels of amine functionality in poly(vinyl alcohol) are not demonstrated to be effective.

U.S. Pat. Nos. 4,880,497 and 4,978,427 discuss the use of amine functional polymers for use in improving the dry and wet strength of paper. These amine functional polymers are based on copolymers comprising 10 to 95 mole % N-vinyl formamide which are hydrolyzed to yield amine functionality. The copolymer also contains an ethylenically unsaturated monomer including vinyl esters (such as vinyl acetate), alkyl vinyl ethers, N-vinyl pyrrolidone, and the esters, nitrites and amides of acrylic acid or methacrylic acid. The problems of copolymerization to yield uniform copolymers of vinyl acetate/N-vinyl formamide above 10 mole % NVF are not noted and the examples shown in these patents do not represent random copolymers but most probably polymer mixtures of various compositions between poly(vinyl acetate) and poly(N-vinyl formamide) (before hydrolysis).

U.S. Pat. No. 4,808,683 Itagaki, et al. (1989) describes a vinylamine copolymer such as a copolymer of N-vinylformamide and N-substituted-acrylamide, which is said to be useful as a paper strengthening agent and European patent application 0,251,182 (1988) describes a vinylamine copolymer formed by hydrolysis of a copolymer of N-vinylformamide and acrylonitrile or methacrylonitrile. The product is said to be useful in papermaking as a drainage aid, retention aid and strength increasing agent. Examples presented to demonstrate the paper strengthening effect of the polymer used a pulp slurry containing cationic starch, alkyl ketene dimer as a sizing agent and a filler retention improving agent, but there is no indication of any cooperative effect between the polymer and the sizing agent.

On the other hand, certain combinations of additives have been found to be useful as paper additives. U.S. Pat. No. 4,772,359, Linhart, et al. (1988) discloses utility of homopolymers or copolymers of N-vinylamides, such as N-vinylformamide (NVF), in combination with phenol resin as a drainage aid in pulp slurries for production of paper. In this service unhydrolyzed poly NVF is said to function cooperatively with the phenol resin, while a partially hydrolyzed poly NVF does not (see Example 6). European patent application No. 0,337,310 (1989) describes improving moist compressive strength of paper products using the combination of hydrolyzed poly(vinyl-acetate-vinylamide) and an anionic polymer such as carboxymethyl cellulose or anionic starch. The hydrolyzed polymer can contain 1–50 mole% vinylamine units and examples are given of polymers having amine functionality of 3–30%.

G. G. Spence in Encyclopedia of Polymer Science and Technology, 2nd Ed., Wiley-Interscience, Vol. 10, p. 761–786, N.Y., 1987, provides a comprehensive survey of paper additives describing the functions and benefits of various additives and resins used in the manufacture of paper. Wet-end additives are discussed at length. Resins containing amine groups that provide cationic functionality and have low molecular weights ($10^3$ to $10^5$) e.g., poly(ethyleneimine), are used to aid retention of fines in the paper. Acrylamide-based water soluble polymers are used as additives to enhance dry strength of paper while a variety of resins, such as melamineformaldehyde resins, improve wet strength. Poly(ethyleneimine), however, is said not to be commercially significant as a wet-strength resin. Sizing agents are used to reduce penetration of liquids, especially water, into paper which, being cellulosic, is very hydrophilic. Sizing agents disclosed are rosin-based agents, synthetic cellulose-reactive materials such as alkyl ketene dimer (AKD), alkenyl succinic anhydrides (ASA) and anhydrides of long-chain fatty acids, such as stearic anhydride, wax emulsions and fluorochemical sizes. Cationic retention aids, such as alum, cationic starch or aminopolyamide-epichlorohydrin wet-strength resin, are used to retain the size particles in the sheet.

SUMMARY OF THE INVENTION

We have found that the addition of crosslinking additives along with polyvinyl alcohol/vinylamine copolymers (PVOH/VAm) at the dry end step of a papermaking process results in unexpected improvements in the properties of the resultant paper products, especially at low levels of copolymer addition; i.e., from about 0.1 to 8 wt% dry-on-dry (dry additive/dry pulp). The properties which are enhanced by this process include wet and dry tensile strength, burst strength and fold resistance. An option of this invention involves the addition of the copolymer at the wet end with the crosslinking additive added at the dry end.

DETAILED DESCRIPTION OF THE INVENTION

Figure 1:
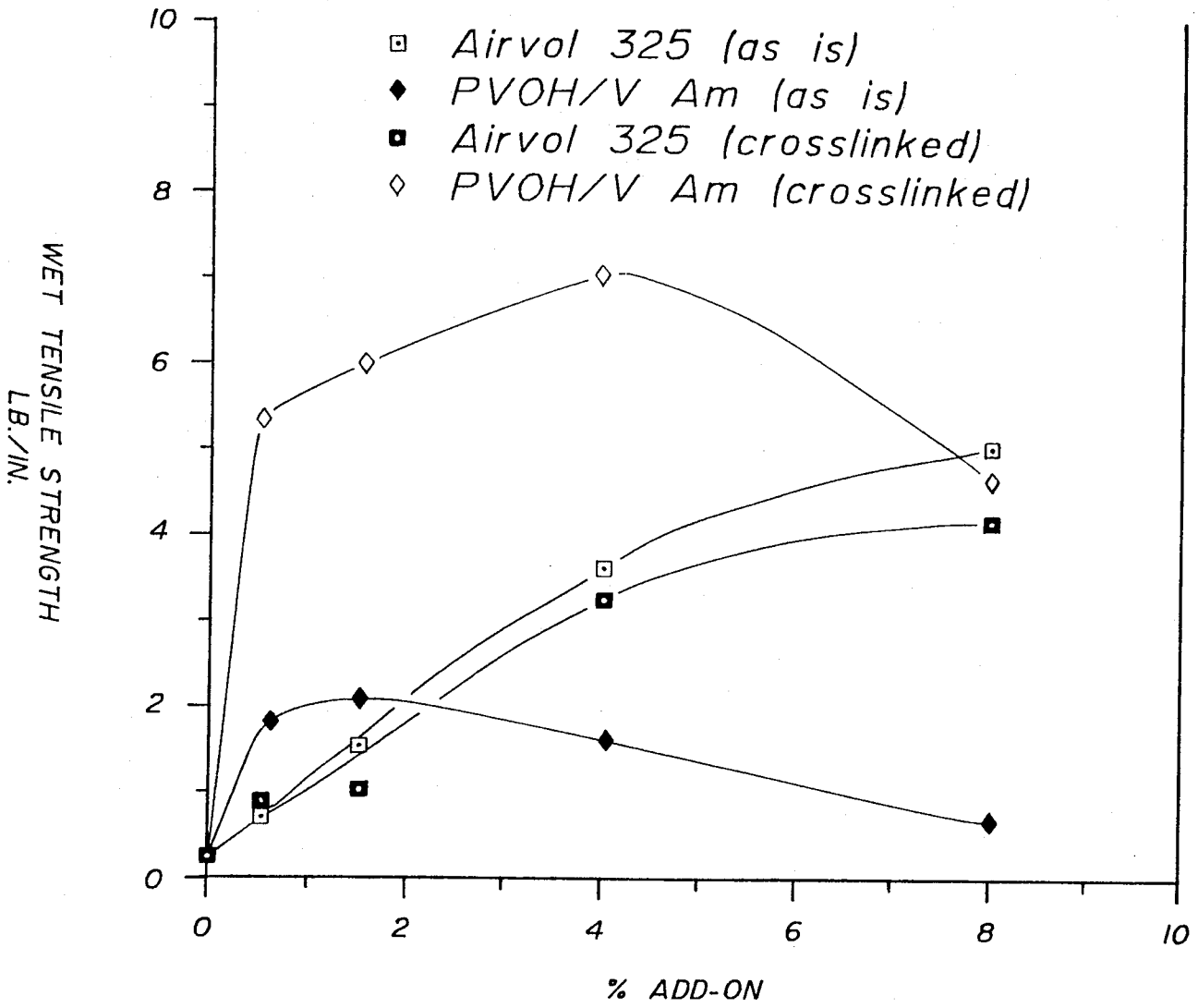
FIG. 1 is a graph of wet tensile strength as a function of wt% (dry-on-dry) copolymer add-on for Airvol 325 (a polyvinyl alcohol avail commercially from Air Products and Chemicals, Inc.); Airvol 325 with a crosslinking agent; PVOH/VAM copolymer; and PVOH/VAM copolymer with a crosslinking agent.

We have found that the addition of crosslinking additives along with polyvinyl alcohol/vinylamine copolymers offer significant improvements in property achievements in dry end addition to cellulosic based materials (e.g. paper and paper-type products). The addition of the crosslinking agents allows for significant property improvements with low levels of PVOH/-VAm addition. For example, wet tensile strength and wet burst strength show significant improvements at copolymer addition levels from about 0.1 to 8 wt% (dry-on-dry) when crosslinking additives are employed. PVOH/VAm crosslinked versions also show improvements in dry tensile strength, dry burst strength and fold resistance at these levels of copolymer addition. Synergistic results are also observed when cellulosic reactive sizes are added. An option to dry end addition of both copolymer and crosslinking additive is to add the copolymer at the wet end of the papermaking operation with the crosslinker added at the dry end. When both the copolymer and the crosslinker are added at the wet end no advantage is seen with crosslinker addition.

The vinyl alcohol/vinylamine copolymers used in this process contain between 0.5 and 25 mole% vinylamine units, with from 2 to 12 moles% being preferred, and can be produced by the polymerization of vinyl acetate/N-vinylamides (e.g. N-vinyl formamide, N-vinyl acetamide) followed by the hydrolysis of both the vinyl acetate (to vinyl alcohol) and the vinyl amide (to vinylamine). Hydrolysis does not have to be complete, and suitable PVOH/VAm copolymers may contain up to 60% of unhydrolyzed amide units and up to 25% unhydrolyzed acetate units.

The preparation of poly(vinyl acetate) and the hydrolysis to poly(vinyl alcohol) are well known to those skilled in the art and are discussed in detail in the books "Poly(vinyl alcohol): Properties and Applications," ed. by C. A. Finch, John Wiley & Sons, N.Y., 1973 and "Poly(vinyl alcohol) Fibers," ed. by I. Sakurada, Marcel Dekker, Inc., N.Y. 1985. A recent review of poly(vinyl alcohol) was given by F.L. Marten in the Encyclopedia of Polymer Science and Engineering, 2nd ed., Vol. 17, p. 167, John Wiley & Sons, N.Y., 1989.

Poly(vinyl acetate) can be prepared by methods well known in the art including emulsion, suspension, solution or bulk polymerization techniques. Rodriguez in "Principles of Polymer Systems," p. 98-101, 403, 405 (McGraw-Hill, N.Y., 1970) describes bulk and solution polymerization procedures and the specifics of emulsion polymerization. Amine functional poly(vinyl alcohol) can be prepared by copolymerization of N-vinyl amides (e.g. Nvinyl formamide or N-vinyl acetamide) or allyl amine with vinyl acetate using methods employed for poly(vinyl acetate) polymerizations. Above 10 mole % incorporation of the N-vinylamides leads to product variations unless delayed feed of the N-vinyl amides is employed. With allyl amine, above 10 mole % leads to lower molecular weight than desired, thus the desired vinyl alcohol copolymers would contain up to 10 mole % allyl amine.

When preparing poly(vinyl acetate) by suspension polymerization, the monomer is typically dispersed in water containing a suspending agent such as poly(vinyl alcohol) wherein an initiator such as peroxide is added thereto. The unreacted monomer is devolatilized after polymerization is completed and the polymer is filtered and dried. This procedure for preparation of poly(vinyl acetate) can also be employed for the vinyl acetate copolymers (as precursors for amine functional poly(vinyl alcohol)) of this invention.

Poly(vinyl acetate) can also be prepared via solution polymerization wherein the vinyl acetate is dissolved in a solvent in the presence of an initiator for polymerization. Following completion of the polymerization, the polymer is recovered by coagulation and the solvent is removed by devolatilization. The vinyl acetate copolymers (as precursors for amine functional poly(vinyl alcohol)) can be prepared via this procedure.

Bulk polymerization is not normally practiced in the commercial manufacture of poly(vinyl acetate) or vinyl acetate copolymers. However, bulk polymerization could be utilized if proper provisions are made for heat of polymerization removal.

Crosslinking agents which are added along with the copolymer include glyoxal, glutaraldehyde, phenol-formaldehyde resins, urea-formaldehyde, melamine-formaldehyde, epoxy resins, maleic anhydride copolymers, diisocyanates, dicarboxylic acids and other crosslinking agents commonly employed for poly(vinyl alcohol). The crosslinking agents can be added to the copolymer prior to addition to the dry end pulp, or may be added separately to the dry end pulp either before or after the addition of the copolymer. Typically, the crosslinking agent is added in a concentration from about 2 to 50 wt% based upon copolymer, with from 4 to 30 wt% being preferred.

The experimental data presented in the examples below demonstrate that PVOH/VAm copolymers with crosslinking additives offer major property improvements (wet and dry tensile strength, burst strength, and fold resistance) over control paper and PVOH modified paper (including PVOH with crosslinking additives) at low levels of add-on with dry end addition. These examples are presented to better illustrate and are not meant to be limiting.

Experimental

The following examples are presented to better illustrate the present invention and are not meant to be limiting.

Sample Preparation

Test samples were prepared as follows using Whatman #4 filter paper all from the same lot (roll). The filter paper was cut into 3"wide pieces which were then weighed. 8% aqueous solutions of the various polymers were prepared in accordance with standard synthesis techniques. Solution solids were adjusted to achieve the desired coat weights. Crosslinking material was added to the solution for those particular tests. The desired solution was poured into a pan and a filter paper sample was then submerged in the pan with solution for several seconds until thoroughly saturated. The polymer saturated sample was then put through an Atlas Padder to remove excess polymer solution. The sized sample was then placed in an oven at 150° C. for 5 minutes. After cooling and equilibrating, the dried filter paper sample was then reweighed and the final coat weight calculated. If the coat weight (wt % copolymer addition) was off from the desired weight, the sample was discarded and the polymer solution solids were adjusted to achieve the desired coat weight. Four samples of the desired weight were prepared, equilibrated in a constant temperature humidity (CTH) chamber (50% R.H. and 24° C. temp.) cabinet overnight and tested.

Gurley Porosity

TAPPI T-460 - Air Resistance of Paper

This test was used to measure the air resistance of paper by measuring the time it takes a given volume of air to pass through a sample.

The test sample, preconditioned at 24° C. and 50% relative humidity, was clamped into the testing apparatus and subjected to air pressure by the weight of the inner cylinder, when released. The amount of time it takes 100 ml of air to pass through the test sample is measured to the nearest 0.1 second.

MIT FOLD

TAPPI T-511 - Folding Endurance of Paper

This test was used to determine the folding endurance of paper. The basic apparatus consists of a stationary clamping jaw, a spring assembly to apply the desired load and an oscillating clamping jaw to induce folding of the sample.

The test sample, pre-conditioned at 24° C. and 50% relative humidity was placed in the test apparatus. The spring assembly was set to 0.25 kilograms. Power was turned on and the oscillating jaw folded the sample 175±25 cycles/min. An automatic counter recorded the number of double fold cycles to sample breakage.

Mullen Burst

TAPPI T-403 - Bursting Strength of Paper

This test was used to measure the bursting strength, both wet and dry, of the paper samples.

The test sample, preconditioned at 24° C. and 50% relative humidity was clamped into the testing apparatus. Power was turned on and air pressure was continually applied to expand a rubber diaphragm until the paper sample burst. The dry burst strength was reported in psi. For wet burst strength, the preconditioned test sample was soaked for 5 seconds in water. The sample was then immediately clamped into the testing apparatus and the burst strength measured in psi.

% Water Absorption

This test was developed to measure the amount of water absorbed by the test sample.

The test sample, preconditioned at 24° C. and 50% relative humidity, was pre-weighed to the nearest 0.01 gram. The sample was then immersed in a pan of water for 5 seconds and then blotted to remove excess surface water and reweighed. The result was reported as the percent of water weight gained with respect to the original samples dry weight.

Tensile Strength

TAPPI T-494 - Tensile Breaking Properties of Paper and Paperboard (using constant rate of elongation apparatus)

A test similar to TAPPI T-494 was used to measure the force per unit width required to break a sample. The test sample, preconditioned at 24° C. and 50% relative humidity is cut into ½ strips. For dry tensiles the strips were clamped into an Instron tensile tester. The gauge length was 4"and crosshead speed was 0.20 in/min. A 20 to 50 pound load range was used depending on the strength of the sample. The dry strips (3–4 samples) were then broken with average dry tensile reported in pounds/inch. For wet tensiles, the ½ strips were soaked in tap water for 30 minutes, blotted and immediately clamped into the Instron. Instrument conditions for wet tensiles were the same as dry tensiles except a 10 pound load range was used. Again 3–4 samples were run and the average wet tensile strength reported in pounds/inch.

Example 1

Samples were prepared according to the previously described Sample Preparation section using polyvinyl alcohol/(10% ) vinylamine (PVOH/VAm), a fully hydrolyzed, medium molecular weight, water soluble copolymer from Air Products and Chemicals. Samples were prepared at a coat weight of 8% with and without Glyoxal N-40 from American Hoechst added at 15% dry based on dry polymer. Results showed the PVOH/-VAm copolymer with no Glyoxal N-40 addition improved all paper properties tested except Gurley Porosity, when compared to untreated Whatman #4 filter paper. All Gurley porosity values are very low and comparable. When 15% Glyoxal N-40 was added, all wet strength properties improved even much more over the untreated filter paper. The Glyoxal N-40 treated samples also showed large improvements over samples without the Glyoxal N-40, especially in wet strength and tear resistance.

TABLE 1

| | Untreated Filter Paper | PVOH/(10%) VAm*HCl 8% Coat Weight | |
|---|---|---|---|
| | | No N-40 | 15% N-40 |
| Tensile Strength (pli) | | | |
| Dry | 10.9 | 17.7 | 19.4 |
| Wet | 0.4 | 0.7 | 8.7 |
| Mullen Burst (psi) | | | |
| Dry | 8 | 38 | 32 |
| Wet | 1 | 3 | 24 |
| MIT Fold | 7 | 347 | 5 |
| % Water Absorption | 159 | 175 | 76 |
| Gurley Porosity (sec) | 2.2 | 2.1 | 3.2 |

Example 2

Samples were prepared according to the previously described Sample Preparation section using polyvinyl alcohol/(5%) vinylamine (PVOH/VAm), a fully hydrolyzed, medium molecular weight, water soluble copolymer from Air Products and Chemicals. Samples were prepared at a coat weight of 8%, with and without Glyoxal N-40 from American Hoechst, Glyoxal N-40 added at 15% dry based on dry polymer. Results showed the PVOH/VAm copolymer with no Glyoxal N-40 addition improved all paper properties tested except Gurley Porosity and wet Mullen Burst, when compared to untreated Whatman #4 filter paper. When 15% Glyoxal N-40 was added, all properties improved except MIT fold over the untreated filter paper. The Glyoxal N-40 treated samples also showed large improvements in wet strengths over samples without the Glyoxal N-40.

TABLE 2

| | Untreated Filter Paper | PVOH/(5%) VAm*HCl 8% Coat Weight | |
|---|---|---|---|
| | | No N-40 | 15% N-40 |
| Tensile Strength (pli) | | | |
| Dry | 10.9 | 14.5 | 20.8 |
| Wet | 0.4 | 0.8 | 8.2 |
| Mullen Burst (psi) | | | |
| Dry | 8 | 33 | 37 |
| Wet | 1 | 2 | 30 |
| MIT Fold | 7 | 469 | 177 |
| % Water Absorption | 159 | 148 | 73 |
| Gurley Porosity (sec) | 2.2 | 1.8 | 3.0 |

Example 3

Samples were prepared according to the previously described Sample Preparation section using polyvinyl alcohol/10% vinylamine (PVOH/VAm), a fully hydrolyzed, medium molecular weight, water soluble copolymer. Samples were prepared at a coat weight of 1.5% dry polymer based on dry paper using 5 and 15% levels (based on dry polymer) of Parez 802 (urea formaldehyde resin from American Cyanamid) for crosslinking. Results showed improvements in wet and dry tensiles, wet and dry Mullen Burst strength and MIT fold resistance over uncrosslinked PVOH/10% VAm and untreated control paper (#4 Whatman filter paper).

TABLE 3

| | Control | No Crosslinker | 5% Parez 802 | 15% Parez 802 |
|---|---|---|---|---|
| Tensile (pli) | | | | |
| Dry | 8.9 | 8.2 | 10.0 | 9.7 |
| Wet | 0.3 | 0.6 | 3.6 | 3.5 |
| Mullen Burst (psi) | | | | |
| Dry | 8 | 14 | 18 | 15 |
| Wet | 1 | 2 | 7 | 6 |
| MIT Fold | 7 | 15 | 23 | 26 |
| % Water Absorption | 165 | 139 | 135 | 139 |
| Gurley Porosity | 1.6 | 1.9 | 1.9 | 1.9 |

Example 4

Samples were prepared according to the previously described Sample Preparation section using polyvinyl alcohol/10% vinyl amine (PVOH/VAm), a fully hydrolyzed, medium molecular weight, water soluble copolymer. Samples were prepared at a lower coat weight of 1.5% dry polymer based on dry paper using 15% level (based on dry polymer) of Cymel 385 (melamine formaldehyde resin from American Cyanamid) for crosslinking. The resin was catalyzed using 2% Cycat 6060 (toluene sulfonic acid type from American Cyanamid). Results showed improvements in wet and dry tensiles, wet and dry Mullen Burst strength and MIT fold resistance over uncrosslinked PVOH/10% VAm and untreated control paper (#4 Whatman filter paper).

TABLE 4

| | Control | No Crosslinker | 15% Cymel 385 |
|---|---|---|---|
| Tensile (pli) | | | |
| Dry | 8.9 | 8.2 | 11.2 |
| Wet | 0.3 | 0.6 | 4.2 |
| Mullen Burst (psi) | | | |
| Dry | 8 | 14 | 22 |
| Wet | 1 | 2 | 9 |
| MIT Fold | 7 | 15 | 28 |
| % Water Absorption | 165 | 139 | 143 |
| Gurley Porosity | 1.6 | 1.9 | 1.9 |

Example 5

Samples were prepared according to the previously described Sample Preparation section using polyvinyl alcohol/(5%) vinylamine (PVOH/VAm), a fully hydrolyzed, medium molecular weight, water soluble copolymer from Air Products and Chemicals and Airvol 325, a fully hydrolyzed, medium molecular weight, polyvinyl alcohol from Air Products and Chemicals. Samples were prepared at coat weights of 0.5, 1.5, 4 and 8%, with and without Glyoxal N-40 from American Hoechst, Glyoxal N-40 added at 15% based on dry polymer.

Figure 2:
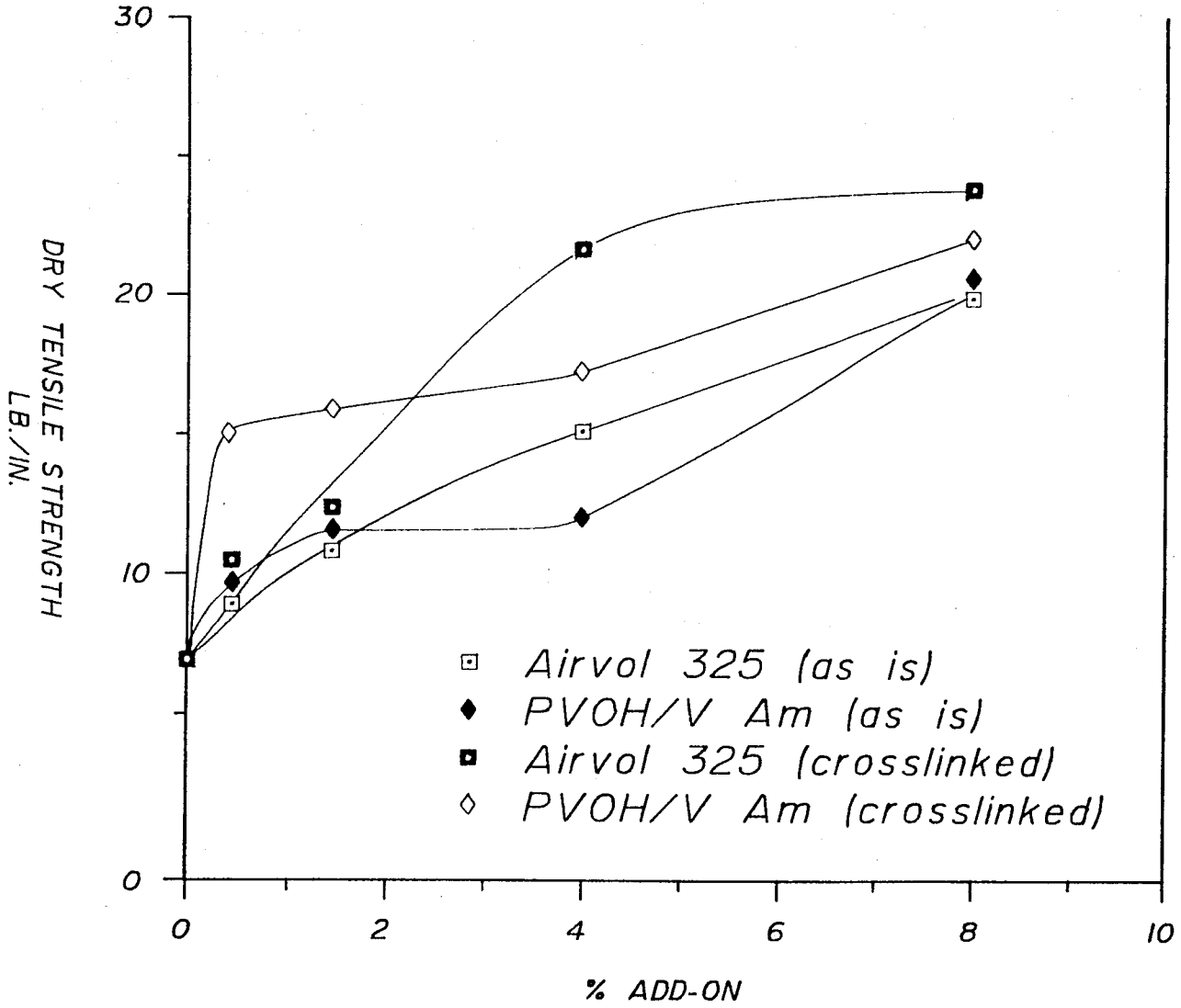
FIG. 2 is a graph of dry tensile strength as a function of wt% (dry-on-dry) copolymer add-on for the same compositions as in the graph of FIG. 1.
Figure 3:
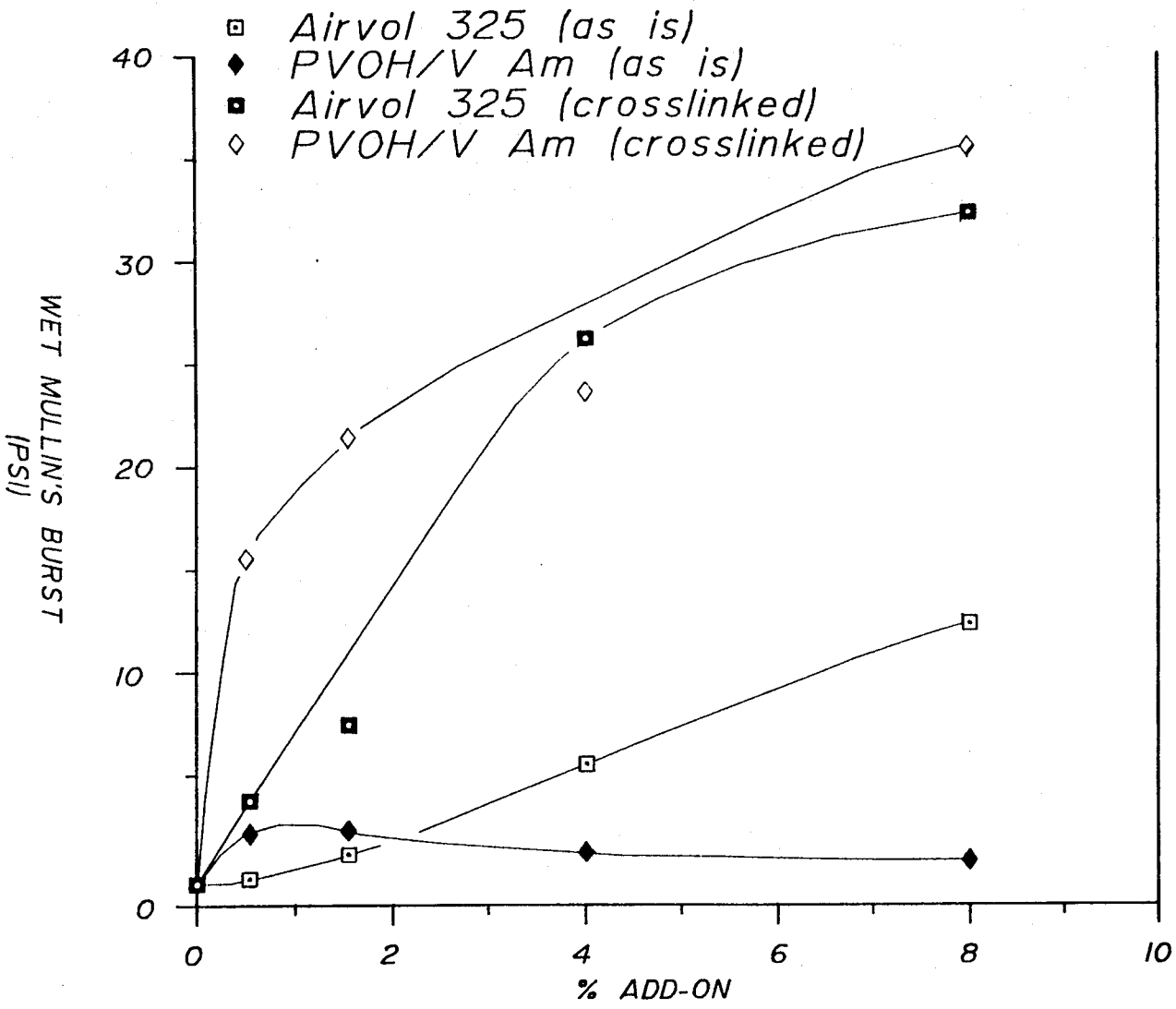
FIG. 3 is a graph of wet burst strength as a function of wt% (dry-on-dry) copolymer add-on for the same compositions as in the graph of FIG. 1.

The results are illustrated in the graphs of FIGS. 1 through 3 for wet tensile strength, dry tensile strength and wet burst strength respectively. The results of all the tests for these samples are set out in Table 5 below.

TABLE 5

| | Control | Airvol 325 | Airvol 325 | Airvol 325 | Airvol 325 | PVOH/PVAm (5%) | PVOH/PVAm (5%) | PVOH/PVAm (5%) | PVOH/PVAm (5%) |
|---|---|---|---|---|---|---|---|---|---|
| NO GLYOXAL | | | | | | | | | |
| Coat Weight (%) | 0.0 | 0.5 | 1.5 | 4.0 | 8.0 | 0.5 | 1.5 | 4.0 | 8.0 |
| Tensiles (pli) | | | | | | | | | |
| Dry | 6.8 | 8.8 | 10.8 | 14.8 | 19.3 | 9.8 | 11.6 | 11.5 | 19.4 |
| Wet | 0.2 | 0.6 | 1.5 | 3.5 | 4.8 | 1.7 | 2.0 | 1.5 | 0.7 |
| Mullen Burst (psi) | | | | | | | | | |
| Dry | 8 | 13 | 18 | 25 | 34 | 20 | 17 | 25 | 34 |
| Wet | 1 | 1 | 2 | 6 | 12 | 3 | 3 | 2 | 2 |
| MIT Fold | 7 | 18 | 37 | 60 | 120 | 23 | 21 | 224 | 447 |
| % Water Absorption | 171 | 148 | 147 | 137 | 135 | 149 | 143 | 162 | 154 |
| Gurley Porosity | 0.9 | 0.9 | 0.9 | 1.1 | 1.4 | 1.1 | 1.1 | 1.0 | 1.0 |
| 15% GLYOXAL | | | | | | | | | |
| Coat Weight (%) | | 0.5 | 1.5 | 4.0 | 8.0 | 0.5 | 1.5 | 4.0 | 8.0 |
| Tensiles (pli) | | | | | | | | | |
| Dry | | 10.4 | 12.2 | 21.1 | 23.2 | 15.1 | 15.6 | 16.8 | 21.2 |
| Wet | | 0.8 | 1.0 | 3.2 | 4.1 | 5.3 | 5.9 | 7.0 | 4.6 |
| Mullen Burst (psi) | | | | | | | | | |
| Dry | | 16 | 20 | 31 | 37 | 25 | 28 | 27 | 37 |
| Wet | | 4 | 7 | 25 | 31 | 15 | 21 | 23 | 34 |
| MIT Fold | | 18 | 38 | 90 | 67 | 87 | 94 | 43 | 105 |
| % Water Absorption | | 137 | 133 | 101 | 90 | 111 | 100 | 95 | 55 |
| Gurley Porosity | | 0.9 | 1.0 | 1.2 | 1.6 | 4.6 | 2.8 | 4.9 | 1.8 |

Example 6

An intermediate size paper machine capable of 500 lbs/hour was employed to make an unbleached paper based on unbleached Southern Softwood Pulp (K#~60) from Champion international. Pulp was added to a pulp chest and mixed with water and added to a beater to reduce the Canadian Freeness to ~650. The resultant pulp was pumped to another pulp chest where a poly(vinyl alcohol/vinylamine) (HCl) (~7 mole% VAm•HCl) was added (predissolved in water). The PVOH/VAm•HCl had a 4% solution pH of 2.99 and a 4% solution viscosity of 45.30 cps. The PVOH/-VAm•HCl was added at dry-on-dry levels of 0.5 wt% and 0.95 wt% on the pulp. The pulp slurry was fed to the paper machine to yield a basis weight of 50 lbs/3000 $ft^2$. The paper width produced was a 48 inch slice with a 42 inch trim. The line rate was 125 ft/min. The dried paper was rolled up after production samples were taken and tested in the machine direction (see Table 6). A control paper without any additives was also produced for comparison. The addition of PVOH/-VAm•HCl (wet-end) yielded increased dry and wet tensile strength and wet and dry burst strength.

The unbleached Kraft paper containing either 0.5% or 0.95% PVOH/VAm copolymer, was post-treated with a solution containing glyoxal N-40. The glyoxal was applied at levels of both 20 and 40% active glyoxal based on dry polymer solids. The glyoxal application was accomplished by saturating the Kraft paper sheet in the appropriate solution, processing the wet paper through an Atlas coater and then curing it in an oven at 150° C. for 5 minutes. Then the samples were conditioned overnight in a CTH chamber (23° C. 50% humidity). After conditioning, the samples were tested for dry and wet tensile strength, dry and wet Mullen burst strength and percent water absorption. Also tested for comparison were papers containing the two levels of PVOH/VAm copolymers without glyoxal post-treatment and untreated control paper.

The glyoxal addition (as a dry-end addition) to the wet-end addition of the PVOH/VAm copolymer yielded significant improvements in wet strength.

TABLE 6

| | Dry Tensile (pli) | Wet Tensile (pli) | % Streng Retain | % Water Absorp | Dry Mullen Burst (psi) | Wet Mullen Burst (psi) | % Streng Retain |
|---|---|---|---|---|---|---|---|
| Control Untreat | 26.3 | 1.2 | 5 | 159 | 31 | 2 | 6 |
| Control 0.5% PVOH/VAm | 31.1 | 4.8 | 15 | 29 | 43 | 17 | 40 |
| 0.5% PVOH/VAm 20% Glyoxal | 37.9 | 10.3 | 27 | 28 | 50 | 22 | 44 |
| 0.5% PVOH/VAm 40% Glyoxal | 37.5 | 10.6 | 28 | 28 | 51 | 29 | 57 |
| Control 0.95% PVOH/VAm | 36.4 | 6.5 | 18 | 35 | 42 | 23 | 55 |
| 0.95% PVOH/VAm 20% Glyoxal | 32.8 | 11.9 | 36 | 28 | 45 | 31 | 69 |
| 0.95% PVOH/VAm 40% Glyoxal | 30.7 | 12.2 | 40 | 29 | 55 | 34 | 62 |

We claim:

1. In a papermaking process, the improvement for producing paper having improved strength properties, said improvement comprising: adding a polyvinyl alcohol/vinylamine copolymer containing between 0.5 and 25 mole% vinylamine units to the paper stock in the papermaking process in an amount from about 0.1 to 8 wt% of dry copolymer based on dry pulp, and also adding to said paper stock a crosslinking agent capable of crosslinking said copolymer, which crosslinking agent is added to the dry end of the papermaking process.

2. A process in accordance with claim 1 wherein said crosslinking agent is selected from the group consisting of glyoxal, gluteraldehyde, phenol-formaldehyde resins, urea-formaldehyde, melamine-formaldehyde, epoxy resins, maleic anhydride copolymers, diisocyanate, dicarboxylic acids and mixtures thereof.

3. A process in accordance with claim 1 wherein said copolymer is added to the paper stock at the dry end of the papermaking process.

4. A process in accordance with claim 1 wherein said copolymer is added to the paper stock at the wet-end of the papermaking process.

5. A process in accordance with claim 1 wherein said crosslinking agent is added to the copolymer prior to being added to the paper stock at the dry-end of the papermaking process.

6. A process in accordance with claim 1 wherein said crosslinking agent is added to the paper stock prior to the addition of the copolymer.

7. A process in accordance with claim 1 wherein said copolymer is added to the paper stock prior to the addition of the crosslinking agent.

8. A process in accordance with claim 1 wherein said polyvinyl alcohol/vinylamine copolymer is produced by the hydrolysis of the corresponding polyvinyl acetate/N-vinylamide copolymer.

9. A process in accordance with claim 1 wherein said copolymer contains between 2 and 12 mole% vinylamine units.

10. A process in accordance with claim 1 wherein a cellulosic reactive size is also added to the dry end of the papermaking process.

* * * * *